US006279324B1

(12) United States Patent
Zhu et al.

(10) Patent No.: US 6,279,324 B1
(45) Date of Patent: Aug. 28, 2001

(54) HEAT-REGENERATING TYPE CRYOGENIC COOLING APPARATUS

(75) Inventors: Shaowei Zhu; Shin Kawano, both of Kariya; Masafumi Nogawa, Toyota; Tatsuo Inoue, Anjo, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/429,350

(22) Filed: Oct. 28, 1999

(30) Foreign Application Priority Data

Oct. 28, 1998 (JP) ..... 10-307386

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS 5,345,770 * 9/1994 Inaguchi ..... 62/6
5,417,071 * 5/1995 Inaguchi ..... 62/6
5,471,841 * 12/1995 Inaguchi ..... 62/6
5,701,742 * 12/1997 Eckels et al. ..... 62/6

* cited by examiner

*Primary Examiner*—Ronald Capossela
(74) *Attorney, Agent, or Firm*—Oblon, Spivak, McClelland, Maier & Neustadt, P.C.

(57) ABSTRACT

A heat-regenerating type cryogenic cooling apparatus 101 includes a cryogenic temperature generating part 10 having a heat regenerator 11; and a pressure generating device 30 connected to the part 10, generating pressure vibration of a working gas therein, and having a compressor 31 with a discharging port 31*a* and a sucking port 31*b*, a high-pressure line 32 whose one end is in fluid communication with the discharging port 31*a* of the compressor 31, a low-pressure line 33 whose one end is in fluid communication with the sucking port 31*b* of the compressor 31, a high-pressure open/close valve 34 connected to the other end of the line 32, a low-pressure open/close valve 35 connected to the other end of the line 33, a high-pressure side line 36 connecting the valve 34 and the 10, a low-pressure side line 37 connecting the valve 35 and the part 10, and a high-pressure side buffer tank 38 as a high-pressure source connected to the midportion of the line 32. At the instant of the opening of the valve 34, the amount of working gas discharged therefrom is the sum of the amount of the working gas discharged from the compressor 31 and the amount of working gas supplied from the high-pressure side buffer tank 38, which prevents lowering pressure in the line 32, thereby improving the cryogenic efficiency.

12 Claims, 6 Drawing Sheets

HEAT-REGENERATING TYPE CRYOGENIC COOLING APPARATUS

BACKGROUND OF THE INVENTION

1. Field of the Invention

The present invention is directed to a heat-regenerating type cryogenic cooling apparatus including a heat regenerator whose interior is packed with a regenerating material, and in particular to an improvement in a pressure vibration device employed in such a heat-regenerating type cryogenic cooling apparatus.

2. Discussion of the Background

FIG. 6 illustrates a conventional heat-regenerating type cryogenic cooling apparatus 104. This apparatus 104 includes a cryogenic temperature generating device 10 and a pressure vibration generating device 20. The cryogenic temperature generating device 10 is constructed by a series connection of a heat regenerator 11, a cold head 12, and an expanding device 13 which are arranged in such an order. The pressure vibration device 20 which establishes a pressure vibration in a working fluid is the cryogenic temperature generating device 10.

The pressure vibration generating device 20 includes a compressor 21 having a discharging port 21*a* and a sucking port 21*b*, a high-pressure line 22 whose one end is in fluid communication with the discharging port 21*a* of the compressor 21, a low-pressure line 23 whose one end is in fluid communication with the sucking port 21*b* of the compressor 21, a high-pressure open/close valve 24 connected to the other end of the high-pressure line 22, a low-pressure open/close valve 25 connected to the other end of the low-pressure line 23, a high-pressure side line 26 connecting the high-pressure open/close valve 24 and the heat regenerator 11, and a low-pressure side line 27 connecting the low-pressure open/close valve 25 and the heat regenerator 11.

As the expanding device 13, there is a piston or other similar element which causes a volume change of working space, in the case of a Gifford-McMahon type cryo-cooler or a Solvay cryo-cooler. In case of a Gifford-McMahon type pulse tube refrigerator, the expanding device 3 is in the form of a pulse tube having therein a hollow volume space.

In the foregoing heat-regenerating type cryogenic cooling apparatus 104, a cyclic pressure vibration is caused by open-close cycling of the valves 24 and 25, and is introduced into a working space which is defined mainly between the heat regenerator 11 and the expanding device 13, in which the cold head 12 is positioned. This causes reciprocal movement of the working gas in the working space, thereby generating a cryogenic temperature at the expanding device 13 which is obtained by way of the cold head 12.

However, while the apparatus 104 is in operation, in the course of the working gas flow into the working space in the cryogenic temperature generating device 10 from the line 22 by opening the valve 24, it is found that the pressure in the line 22 fails to keep the designed value and becomes smaller by a slight value, while if the valve 24 is closed the pressure in the line 22 increases beyond the designed value. Similarly, while the apparatus is in operation, in the course of the working gas flow from the working space in the cryogenic temperature generating device 10 into the line 23 by opening the valve 25, it is found that the pressure in the line 23 fails to keep the designed value and becomes larger by a slight value, while if the valve 25 is closed the pressure in the line 23 increases beyond the designed value. Such a pressure decrease in the line 22 and a pressure increase in the line 23 affects the behavior of the working gas in the working space, which lowers the cooling efficiency.

In detail, immediately upon simultaneous closure of the valve 25 and opening of the valve 24, the pressure in the line 22 falls, which causes the pressure in the working space to gradually approach the designed value, and in the worst case to fail to reach this value. Similarly, immediately upon simultaneous closure of the valve 24 and opening of the valve 25, the pressure in the line 23 increases, which causes a pressure in the working space to gradually approach the designed value and in the worst case to fail to reach this value. Such gradual changes in approaching the designed values reduce the PV-work or the virtual PV-work. In addition, a ripple of working gas occurs in the line 22 (23) every time that a cycle of operations of the valve 24 (25) terminates, which also lowers the cooling efficiency.

SUMMARY OF THE INVENTION

It is, therefore, a principal object of the present invention to provide a heat-generating type cryogenic cooling apparatus which is free from the foregoing drawbacks.

Another object of the present invention is to improve a pressure vibration device of a heat-generating type cryogenic cooling apparatus wherein a deviation of the pressure in each of the high-pressure and the low-pressure lines from the designed reference value is kept as small as possible, to prevent lowering the efficiency of the cryogenic cooling apparatus.

The invention is based upon the novel recognition that when lowering the pressure in the high-pressure line while the working gas is being supplied from the pressure vibration device to the working space of the cryogenic temperature generating device by way of the opening of the high-pressure open/close valve, the discharged amount of the working gas from the high-pressure line toward the cryogenic temperature generating device becomes greater than the discharged amount of the working gas from the compressor to the high-pressure line, which results in an expansion of the working gas in the high-pressure line to cause an instantaneous pressure drop therein.

In view of this phenomenon, the heat-regenerating type cryogenic cooling apparatus according to the present invention comprises a cryogenic temperature generating part including a heat regenerator; and a pressure vibrating part connected to the cryogenic temperature generating part and establishing pressure vibration of a working gas therein, the pressure vibrating part including a compressor having a sucking port and a discharging port, a high-pressure line whose one end is connected to the discharge port of the compressor, a low pressure line whose one end is connected to the sucking port of the compressor, a high-pressure open/close valve connected to the other end of the high-pressure line, a low-pressure open/close valve connected to the other end of the low-pressure line, a high-pressure side passage connecting the high-pressure open/close valve and the cryogenic temperature generating part, a low-pressure side passage connecting the low-pressure open/close valve and the cryogenic temperature generating part, and a high-pressure source in fluid communication with the high-pressure line.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
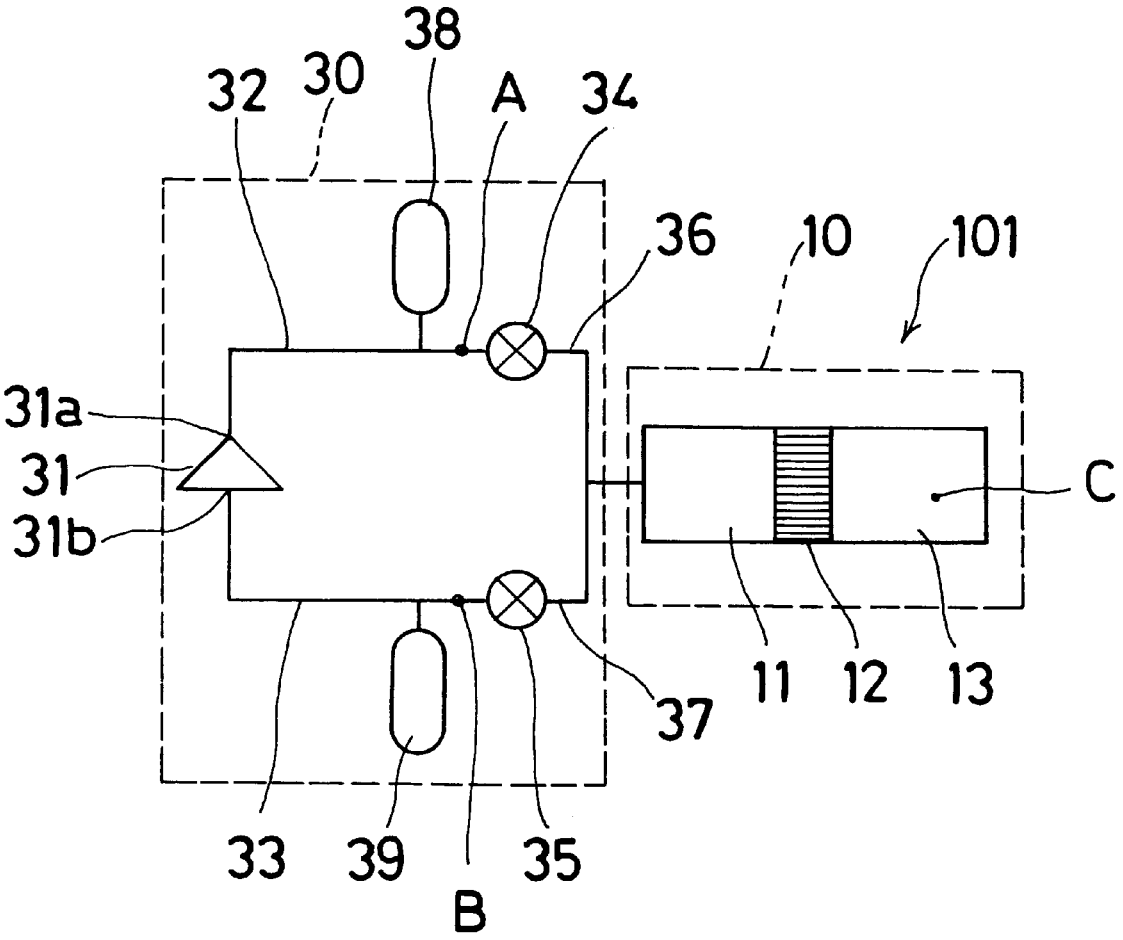
FIG. 1 is a schematic diagram of a heat regenerating type cryogenic cooling apparatus in accordance with an embodiment of the present invention.

Referring now to the drawings, wherein like reference numerals designate identical or corresponding parts throughout the several views, FIG. 1 illustrates a heat-regenerating type cryogenic cooling apparatus 101 in accordance with an embodiment of the present invention. This apparatus 101 includes a cryogenic temperature generating device 10 and a pressure vibration device 30. The cryogenic temperature generating device 10 is constructed by a series connection of a heat regenerator 11, a cold head 12, and an expanding device 13 which are arranged in such an order. The pressure vibration generating part 30 establishes a pressure vibration in a working fluid in the cryogenic temperature generating device 10.

The pressure generating device 30 includes a compressor 31 having a discharging port 31*a* and a sucking port 31*b*, a high-pressure line 32 whose one end is in fluid communication with the discharging port 31 a of the compressor 31, a low-pressure line 33 whose one end is in fluid communication with the sucking port 31*b* of the compressor 31, a high-pressure open/close valve 34 connected to the other end of the high-pressure line 32, a low-pressure open/close valve 35 connected to the other end of the low-pressure line 33, a high-pressure side line 36 connecting the high-pressure open/close valve 34 and the heat regenerator 11, a low-pressure side line 37 connecting the low-pressure open/close valve 35 and the heat regenerator 11, a high-pressure side buffer tank 38 as a high-pressure source connected to a mid-portion of the high-pressure line 32, and a low-pressure side buffer tank 39 as a low-pressure source connected to the low-pressure line 33.

As the expanding device 13, a piston or other similar element is used, which causes a volume change of the working space in case of a Gifford-McMahon type cryocooler or a Solvay cryocooler. In case of a Gifford-McMahon type pulse tube refrigerator, the expanding device 13 is in the form of a pulse tube having therein a hollow space.

In the foregoing heat-regenerating type cryogenic cooling apparatus 101, a cyclic pressure vibration is caused by cyclical open-close operation of the valves 34 and 35, and is introduced into a working space which is defined mainly between the heat regenerator 11 and the expanding device 13, in which the cold head 12 is positioned. This causes reciprocal movements of the working gas in the working space, thereby generating a cryogenic temperature at the expanding device 13 which is obtained by way of the cold head 12.

Figure 2:
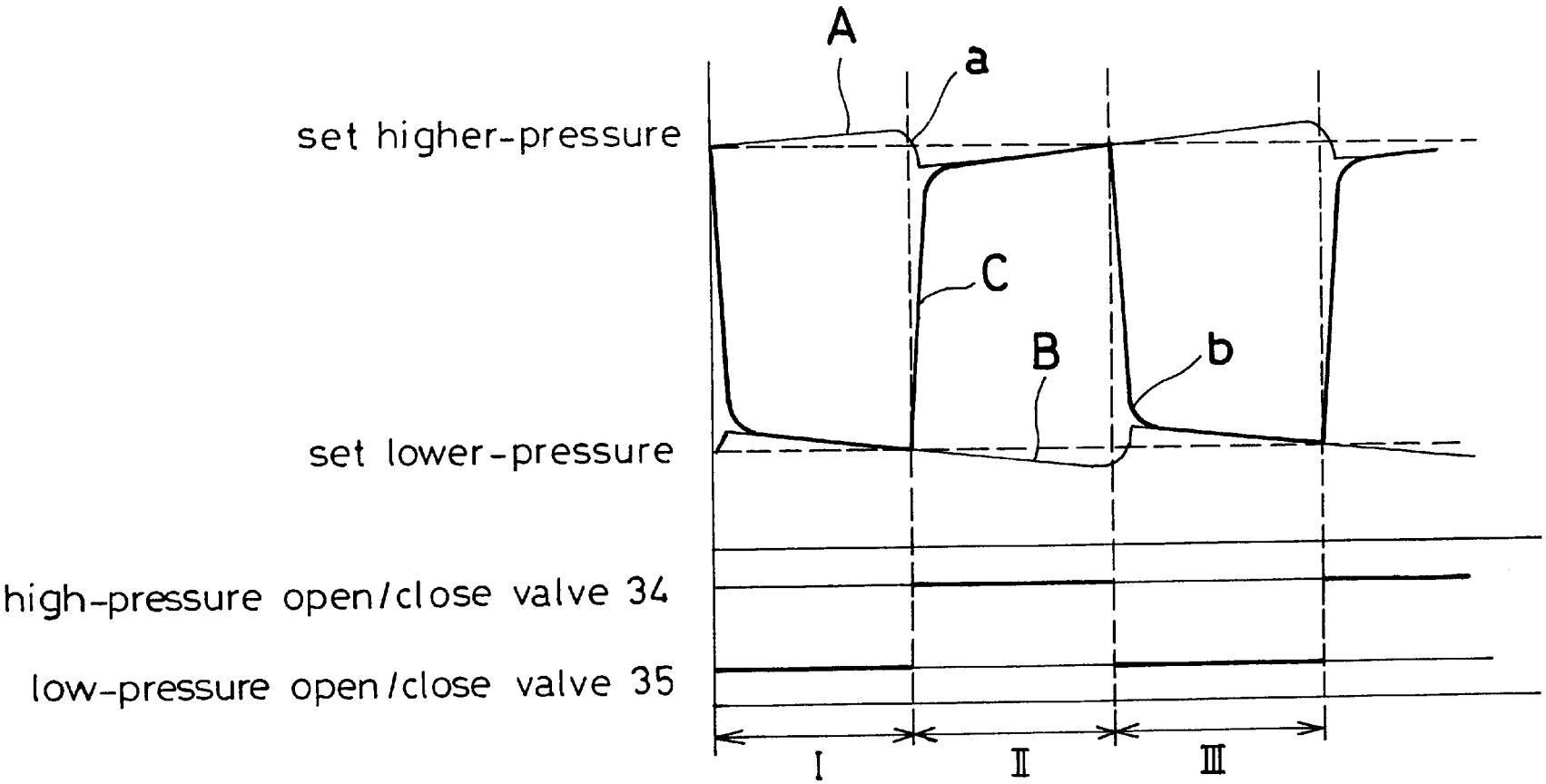
FIG. 2 is a graph indicating a characteristic of the apparatus shown in FIG. 1.
Figure 3:
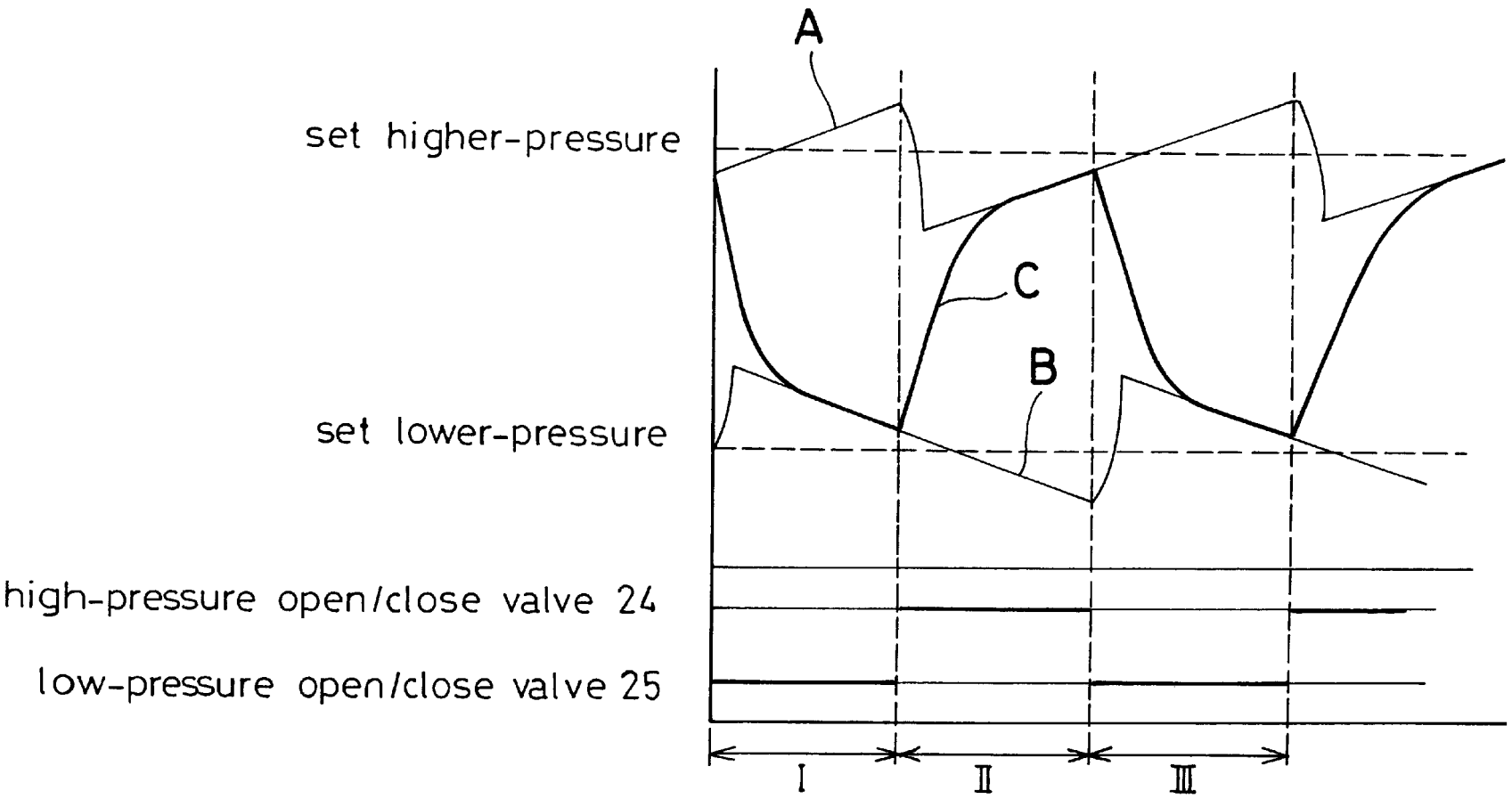
Fig. 3 (PRIOR ART)
FIG. 3 is a graph indicating characteristic of a conventional apparatus.

FIG. 2 depicts a graph of operating characteristics of the heat-regenerating type cryogenic cooling apparatus 101. In detail, FIG.2 is a graph showing states of the high-pressure open/close valve 34 and the low-pressure open/close valve 35, and pressure changes in the high-pressure line 32 and the low-pressure line 33. FIG. 3 is a comparative graph prepared which depicts corresponding operating characteristics of the conventional heat-regenerating type cryogenic cooling apparatus 104. In FIGS. 2 and 3, the opened and closed conditions of each of the valves are depicted in bold and thin lines, respectively, the pressure change in the high-pressure line 32 (22) is depicted in thin line indicated with 'A', the pressure change in the low-pressure valve 33 (23) is depicted in thin line indicated with 'B', and the pressure change in the working space 13 is depicted in bold line indicated with 'C'.

First of all, focusing on phase I in FIG. 2 (3) wherein the high-pressure open/close valve 34 (24) and the low-pressure open/close valve 35 (25) are closed and opened, respectively, the pressure change in the high-pressure line 32 which follows the thin line 'A' in FIG. 2 rises in relatively gradual manner with the passing of time and therefore the pressure rising gradient is small, while the pressure change in the high-pressure line 22 which follows the thin line 'A' in FIG. 3 rises sharper than that in FIG. 2. This results from the fact that in this embodiment the interior of the high-pressure side buffer tank 38 connected to the high-pressure tank 32 constitutes an effective or apparent volume enlargement of the high-pressure line 32. In other words, in the present embodiment, while the high-pressure open-close valve 34 is being closed, the volume of the working space in which the working gas is to be filled is the sum of the interior volume of the high-pressure line 32 and the interior volume of the high-pressure side buffer tank 38. Thus, the space to be filled with the working gas can become larger, thereby making the slope of pressure increase more gentle. On the contrary, in the conventional heat-regenerating type cryogenic cooling apparatus 104, no buffer tank is connected to the high-pressure line 22, which means that the space to be filled with the working gas from the compressor 21 includes only the high-pressure line 22, thereby making the slope of pressure increase more sharp than the slope of pressure increase in the present invention.

The load of the compressor varies correspondingly with the slope of pressure increase in the high pressure line, which is important from the viewpoint of durability of the compressor. In the present embodiment, the slope of pressure increase in the high-pressure line 32 becomes gentler or smaller than the conventional one, which reduces load variation of the compressor 31, thereby improving remarkably the durability of the compressor 31.

As can be seen from FIG.3, the pressure in the high-pressure line 22, at the end of phase I, takes a considerably higher position above the set or reference high-pressure value in the conventional apparatus 104. On the contrary, as evident from FIG. 2, the pressure in the high-pressure line 32 of the apparatus 101 according to the present embodiment is smaller than that in FIG. 3, and thereby closer to the reference or set high-pressure value. The reason is that, as explained above in the apparatus 101 according to the present embodiment, the high-pressure line 32 is in fluid communication with the high-pressure side buffer tank 38, which makes the slope of pressure increase in the high-pressure line 32 gentle, thereby restricting the final pressure of the high-pressure line 32 to be smaller, while in the conventional apparatus 104 the slope of pressure increase in the high-pressure line 32 becomes larger, which makes the pressure of the high-pressure 32 higher. Thus, in the apparatus 101 according to the present embodiment, due to the lower final pressure of the high-pressure line 32, the load of the compressor 31 is smaller than that of the compressor 21 of the conventional apparatus 104, which decreases the input work of the compressor 21, thereby improving the cooling efficiency of the apparatus 101.

Next, if pressure changes in the apparatus 101 focus on an instant when a phase transfers from phase I to phase II during which the high-pressure open/close valve and the low-pressure open/close valve are being opened and closed, respectively, in FIG. 2, though the pressure in the high-pressure line 32 drops a little as indicated at 'a', such a drop fails to proceed and a subsequent quick pressure increase is found in the high-pressure line 32. This can be analyzed as follows: At the instant when the high-pressure open/close valve 32 is switched from its closed state to its opened state, the working gas begins to flow into the cryogenic temperature generating part 10 from the high-pressure line 32 which receives the working fluid from both the discharging port 31*a* of the compressor 31 and the high-pressure side buffer tank 38. Thus, the working gas discharged from the high pressure buffer tank 38 increments the working gas to the high-pressure line 32, thereby establishing a small pressure decrease in the high-pressure line 32 due to the amount of working gas flowing into the high-pressure line 32 being smaller than that the amount of working gas flowing out from the high-pressure line 32. On the contrary, as can be seen from FIG. 3, the pressure in the conventional high-pressure line 22 falls considerably since the conventional high-pressure line 22 is provided with no high-pressure side buffer tank and the amount of working gas which flows into the high-pressure line is only the amount of working gas discharged from the compressor 21. Accordingly, at the instant of the state change of the high-pressure open/close valve 24, the amount of working gas discharged from the compressor 21 fails to keep up with the amount of working gas which flows out to the cryogenic temperature generating part 10 from the high-pressure line 22.

In addition, at the instant when the state change of the high-pressure open/close valve 34 occurs from its closed state to open state, the pressure in the working space changes in a rapid rising manner from the reference or set low-pressure value and then approaches gradually the pressure value in the high-pressure line 32 in the apparatus 101 according to the present embodiment, as can be seen from FIG.2, while in the conventional apparatus 104, as shown in FIG. 3, the pressure in the working space changes in a gentle rising manner from the reference or set low-pressure value and approaches gradually the pressure value in the high-pressure line 22. Such a difference is due to the following facts: In FIG. 2, the pressure decrease in the high-pressure line 32 is small, which causes a sufficient pressure difference between the working space and the high-pressure line, thereby increasing the pressure in the working space in rapid. Thus, the resultant pressure begins immediately to approach the pressure in the high-pressure line 32. On the contrary, in FIG. 3, the pressure decrease in the high-pressure line is large, which causes an insufficient pressure difference between the working space and the high-pressure line 22, thereby gently increasing the pressure in the working space. Thus, the resultant pressure begins to approach the pressure in the high-pressure line 22 in a more gradual manner.

When phase II is considered, the thin line referenced with 'B' in FIG. 2 indicates that the pressure in the low-pressure line 34 falls or drops in a gradual manner with the passing of time, which is indicative of a small lowering gradient of pressure. On the contrary, the pressure change of the low-pressure line 23 which follows the thin line indicated with 'B' in FIG. 3 is found to be more sharp than that in FIG. 2. This results from the fact that in the present embodiment the connection of the low-pressure side buffer tank 39 to the low-pressure line 33 brings about a virtual enlargement of the interior of the low-pressure line 33 when compared with the conventional one. In detail, in the apparatus 101 according to the present embodiment, while the low-pressure open/close valve 35 is being closed, the volume of the working space in which the working gas is to be filled is the sum of the interior volume of the low-pressure line 22 and the interior volume of the low-pressure side buffer tank 39. Accordingly, the space to be filled with the working gas is larger than the conventional one, thereby making the slope of pressure increase more gentle. On the contrary, in the conventional heat-regenerating type cryogenic cooling apparatus 104, no buffer tank is connected to the low-pressure line 23, and so the space to be filled with the working gas from the compressor 21 includes only the low-pressure line 23, thereby making the slope of pressure decrease more sharp than the slope of pressure decrease in the present invention.

The load of the compressor varies correspondingly with the slope of pressure decrease in the low pressure line, which is important from the viewpoint of durability of the compressor. In the present embodiment, the slope of pressure decrease in the low-pressure line 33 becomes gentler or smaller than the conventional one, which reduces load variation of the compressor 31, thereby improving remarkably the durability of the compressor 31.

As can be seen from FIG. 3, the pressure in the low-pressure line 23 at the end of phase II takes a considerably lower position than the set or reference low-pressure value in the conventional apparatus 104. On the contrary, as appreciable from FIG. 2, the pressure in the low-pressure line 22 of the apparatus 101 according to the present embodiment is closer to the reference or set low-pressure value. The reason is that in the apparatus 101 according to the present embodiment, the low-pressure line 33 is in fluid communication with the low-pressure side buffer tank 39, which makes the slope of pressure decrease in the low-pressure line 33 gentle, thereby restricting the final pressure of the low-pressure line 33, while in the conventional apparatus 104, the slope of pressure decrease in the low-pressure line 23 becomes larger, which makes the pressure of the low-pressure line 23 lower. Thus, in the apparatus 101 according to the present embodiment, the load variation of the compressor 31 is smaller than that of the compressor 21 of the conventional apparatus 104, which decreases the input work of the compressor 21, thereby improving cooling efficiency of the apparatus 101.

If pressure changes at portions in the apparatus 101 are focused at an instant when a phase shift is made from phase II to phase III during which the high-pressure open/close valve and the low-pressure open/close valve are being closed and opened, respectively, in FIG. 2, though the pressure in the low-pressure line 33 rises a little as indicated with 'b', such a rise falls to proceed and a subsequent pressure decrease in a gradual manner is found in the low-pressure line 33. The reason is as follows: At the instant when the low-pressure open/close valve 35 is switched from its closed state to its open state, the working gas enters the low-pressure line 33 from the cryogenic temperature generation part 10, and is sucked into both the sucking port 31*b* of the compressor 31 and the low-pressure side buffer tank 39, which increases the total amount of working gas discharged from the cryogenic temperature generation part 10, thereby allowing a balance between sucking and flow in working gas amounts. Thus, the pressure rise in the low-pressure line 32 can be made as small as possible. On the contrary, the pressure in the conventional low-pressure line, as can be seen from FIG. 3, is at a considerably lowered point and the subsequent pressure rise is drastic. This is due to the fact that the amount which flows out from the cryogenic temperature generating part 10 cannot be sucked fully into the compressor 31.

In addition, at the instant when a state change of the low-pressure open/close valve 35 occurs from its closed state to its open state in the apparatus 101 according to the present embodiment, it can be seen in FIG. 2 that the pressure in the working space changes in rapid falling manner from the reference or set high-pressure and then approaches gradually the pressure in the low-pressure line 33. On the contrary, as shown in FIG. 3, in the conventional apparatus 104, the pressure in the working space changes in a gentle falling manner from the reference or set high-pressure and approaches gradually the pressure in the conventional low-pressure line 23. The reason why such a difference occurs is as follows: In FIG. 2, the pressure rise is small at the moment when a phase shift is made from II to III, and a sufficient pressure difference can be set between the working space and the low-pressure line, which causes a rapid, sharp falling of the pressure in the working space, with the result that an immediate approach of the pressure in the working space to the pressure in the low-pressure line. On the contrary, in FIG. 3, the pressure rise is large at the moment when a phase shift is made from phase II to phase III, and a sufficient pressure difference cannot be set between the working space and the low-pressure line, which causes a gentle falling of the pressure in the working space.

Moreover, in FIG. 2, the pressure in the working space at the termination of phase I and the pressure in the working space at termination of phase II reach the set low-pressure value and the set-high-pressure value, respectively, while In FIG. 3 the pressure in the working space at the termination of phase I and the pressure in the working space at the termination of phase II are higher than the set lower-pressure value and lower than the set high-pressure value, respectively. The reason for such a difference is as follows: In the case of the conventional apparatus 104, in FIG. 3, at the initiation of phase I or at the instant of the opening of the low-pressure valve 25, the pressure increase of the low-pressure line 23 becomes large, by which the pressure in the low-pressure line 23 fails to fall to the set low-pressure value before the low-pressure open/close valve 25 is closed at the termination of phase I, with the result that the pressure in the working space which approaches the pressure of the low-pressure line 23 in a gradual manner fails to fall to the set-lower pressure value. Likewise, in the conventional apparatus 104, at the initiation of phase II or at the instant of the opening of the high-pressure open/close valve 24, the pressure decrease of the high-pressure line 22 becomes large, by which the pressure In the high-pressure line 22 fails to raise to the set high-pressure valve before the high-pressure open/close valve 24 is closed at the termination of phase II, with the result that the pressure in the working space which approaches the pressure of the high-pressure line 22 in a gradual manner fails to rise to the set high pressure value. On the contrary, in the apparatus 101 according to the present embodiment, the pressure rise in the low-pressure line 33 at the initiation of phase I and the pressure fall in the high-pressure line 32 at the initiation of phase II are small, by which the pressure of the low-pressure line 33 at the termination of phase I and the pressure of the high-pressure line 32 at the termination of phase II can be made lower and higher, respectively. Thus, the pressure of the working space which approaches gradually to the pressure of the low-pressure line 33 in phase I becomes the set low pressure value at the termination of phase I and the pressure of the working space which approaches gradually to the pressure of the high-pressure line 32 in phase II becomes the set high-pressure value at the termination of phase II.

The cryogenic efficiency of the apparatus 101 is very strongly affected by the pressure of the working space at the termination of each of phase I and phase II, the rising slope of the inner pressure of the working space when the state change of each of the open/close valves 34 and 35 occurs, and the falling slope of the inner pressure of the working space when he state change of each of the open/close valves 34 and 35 occurs. The apparatus 101 according to the present embodiment is expected to have improved cooling efficiency in which the inner pressure of the working space reaches or sufficiently approaches the set pressure value at the termination of either of phase I and phase II, when compared with the conventional apparatus wherein the working gas fails to attain the set pressure value at the termination of either of phase I and phase II. In addition, in the apparatus 101 according to the present invention the rising and falling slope of the inner pressure of the working space are very sharp when the state of each of the open/close valves 34 and 35 changes, which results in improvement of cryogenic efficiency when compared to the conventional apparatus 104 from which such sharp slopes are not readable.

It is preferable to connect the high-pressure side buffer tank 38 to the high-pressure line 32 near the high-pressure open/close valve 34. The reason is that where the high-pressure side buffer tank 38 is placed remote from the high-pressure open/close valve 34, when the high-pressure open/close valve 34 is opened, the discharge response of the working gas from the high-pressure side buffer tank 38 will be delayed, thereby weakening the supplemental effect of working gas discharging from the high-pressure buffer tank 38. On the contrary, positioning the high-pressure side buffer tank 38 near the high-pressure open/close valve 34 allows a quick discharge of the working gas from the high-pressure side buffer tank 38 in response to the opening of the high-pressure open/close valve 34, thereby realizing fully the supplemental effect of working gas discharging from the high-pressure buffer tank 38.

Likewise, the low-pressure side buffer tank 39 is desired to be connected to the low-pressure line 33 in the vicinity of the low-pressure open/close valve 35. In case where the low-pressure side buffer tank 39 is connected to the low-pressure line 33 remotely from the low-pressure open/close valve 35, when the low-pressure open/close valve 35 is opened, the sucking response of the working gas into the low-pressure side buffer tank 39 will be delayed, thereby weakening the effect of working gas sucking into the low-pressure buffer tank 39. On the contrary, positioning the low-pressure side buffer tank 39 near the low-pressure open/close valve 35 allows quick sucking of the working gas from the low-pressure side buffer tank 39 in response to the opening of the low pressure open/close valve 35, thereby realizing fully the effect of working gas sucking into the low-pressure buffer tank 39.

With respect to the volume of each of the high-pressure side buffer tank 38 and the low-pressure side buffer tank 39, enlarging such a volume affects in the corresponding effect.

Preferably, each of the high-pressure side buffer tank 38 and the low-pressure side buffer tank 39 should have a volume which is 1–10 times larger than the volume of the working space. If the volume of each buffer tank is less than 1 time of the volume of the working space, the effect can not be expected. If more than 10 times, a space problem may occur.

As described above, the heat-regenerating type cryogenic cooling apparatus 101 in accordance with the present embodiment includes the high-pressure side buffer tank 38 as a high-pressure source connected to the mid-portion of the high-pressure line 32, with the result that at the instant of the opening of the high-pressure open/close valve 34, the amount of working gas discharged therefrom is the sum of the amount of the working gas discharged from the compressor 31 and the amount of working gas supplied from the high-pressure side buffer tank 38, which prevents lowering pressure in the high-pressure line 32, thereby improving the cryogenic efficiency. In addition, the pressure in the high pressure line 32 is stabilized with fewer ripples of the working gas, so that a reduced cryogenic efficiency caused by the ripple of the working gas can be prevented.

Moreover, the apparatus 101 according to the present embodiment includes the low-pressure side buffer tank 39 as low pressure source which is connected to the mid-portion of the low-pressure line 33, with the result that at the instant of the opening of the low pressure open/close valve 35 the working gas is sucked into the compressor 31 and the low-pressure side buffer tank 39, which causes an increase of the total amount of working gas to be sucked, thereby lessening lowering pressure in the low-pressure line 33. Thus, the cryogenic efficiency can be also increased. In addition, the pressure in the low-pressure line 33 is stabilized with no or less ripples of the working gas, so that any lower cryogenic efficiency caused by the ripples of the working gas can be prevented.

Figure 4:
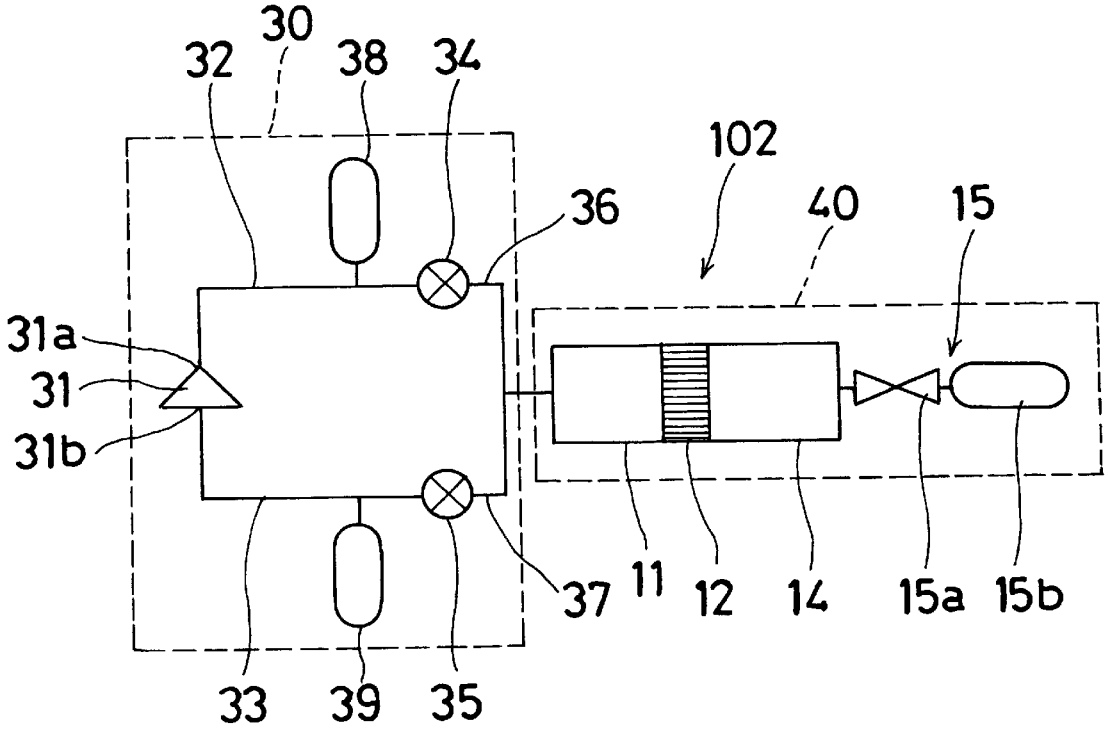
FIG. 4 is a schematic diagram of a Gifford-McMahon type pulse tube refrigerator as an application mode of the apparatus shown in FIG. 1.

Referring to FIG.4, there is illustrated a GM (Gifford-McMahon) type pulse tube refrigerator 102 which is an application version of the apparatus 101. The GM type pulse tube refrigerator 102 includes a cryogenic temperature generating part 40 having a heat regenerator 11, a cold head 12, and a phase shifter 15 having an orifice 15*a* and a buffer tank 15*b* which are arranged in such an order, and a pressure vibrating part 30 connected to the heat regenerator 11 for generating pressure vibration in a working gas in the cryogenic temperature generating part 40. The structure of the pressure vibrating part 30 is identical with that in the apparatus 101, which omits the detailed explanation of the former.

In the GM type pulse tube refrigerator 102, when the pressure vibration of the working gas is generated by controlling open-close cyclings of the high-pressure open/close valve 34 and the low-pressure open/close valve 35, the working gas having the resultant pressure vibration is introduced into the working space which is constituted by the heat regenerator 11, the cold head 12, the pulse tube 14 and passages between two adjacent elements. In addition, the phase shifter 15 makes a phase difference between pressure vibration and displacement. Adjusting such a phase difference to an optimum generates a cryogenic temperature at a cold head of the pulse tube 14 which is adjacent to the cold head 12 and the resultant cryogenic temperature can be obtained from the cold head 12.

Figure 5:
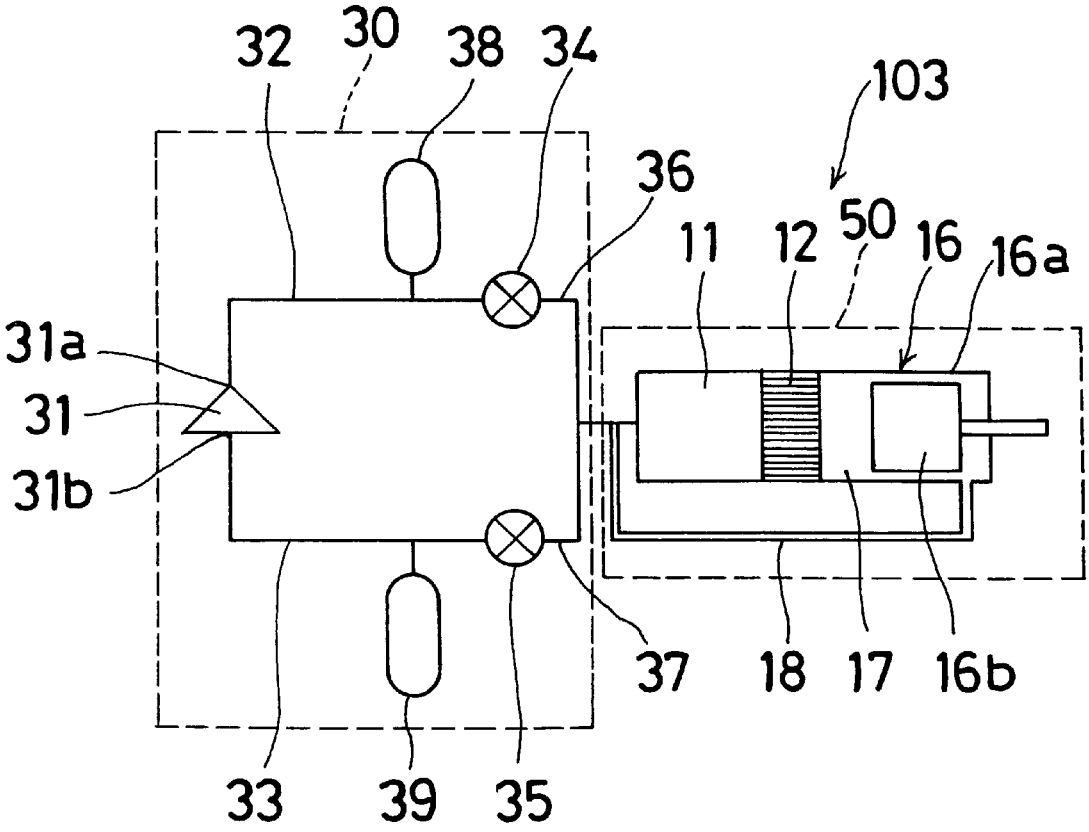
FIG. 5 is a schematic diagram of a Gifford-McMahon type refrigerator as another application mode of the apparatus shown in FIG. 1.
Figure 6:
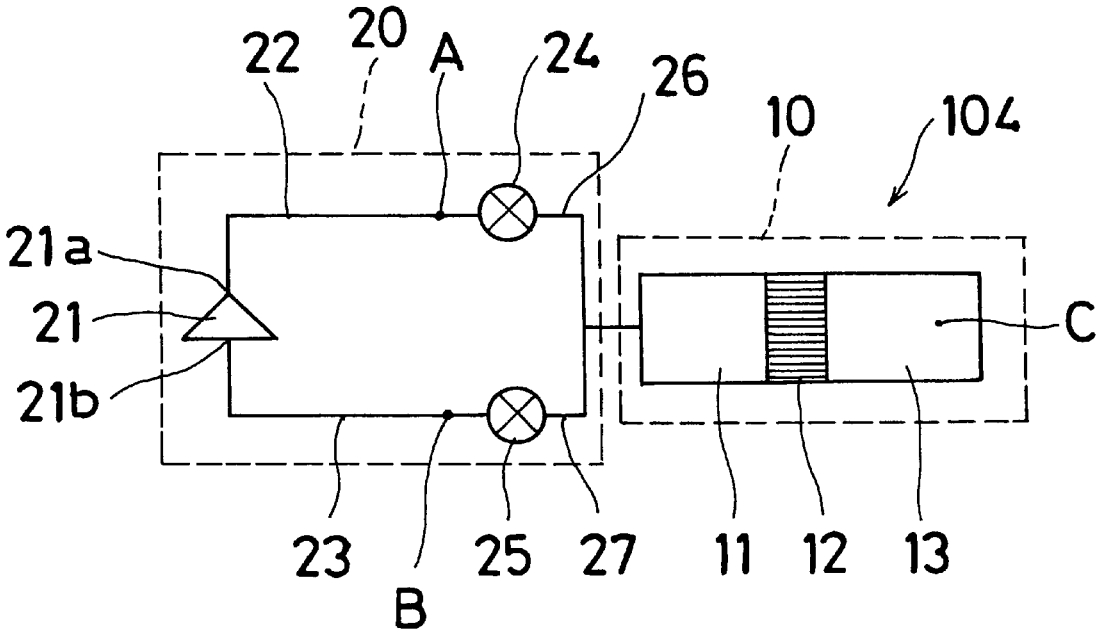
Fig. 6 (PRIOR ART)
FIG.6 is a schematic diagram of a conventional heat-regenerating type cryogenic cooling apparatus.

Referring to FIG. 5, there is illustrated another GM (Gifford-McMahon) type pulse tube refrigerator 103 which is an application version of the apparatus 101. The GM type pulse tube refrigerator includes a cryogenic temperature generating part 50 having a heat regenerator 11, a cold head 12, and an expansion part 16 which are arranged in this order and a pressure vibrating part 30 connected to the heat regenerator 11 for generating pressure vibrations of the working gas in the cryogenic temperature generating part 50. The structure of the pressure vibrating part 30 is identical with that in the apparatus 101, which omits the detailed explanation of the former.

The expansion part 16 includes a cylinder 18*a* and a displacer piston 16*b* fitted therein in a slidable manner which is reciprocated by an external driving mechanism (not shown). In the cylinder 16*a*, there is defined an expansion space between the displacer 16*b* and the cold head 12. A back side space of the displacer 16*b* and a higher temperature end of the heat regenerator 11 which is remote from the cold head 12 are in continual fluid communication by way of a conduit 18. The purpose of the conduit 18 is to bring the back side space and the front side space or the expansion space into equilibrium, and therefore so long as such a purpose is attained any other devices can be employed.

In the GM type pulse tube refrigerator 103, when the pressure vibration of the working gas is generated by controlling open-close cycling of the high-pressure open/close valve 34 and the low-pressure open/close valve 35, the working gas having the resultant pressure vibration is introduced into the working space 40 which is constituted by the heat regenerator 11, the cold head 12, the pulse tube 14 and passages between two adjacent elements. In addition, the displacer 16*b* is reciprocated in the cylinder 16*a*. Both the pressure vibration and the reciprocal movements of the displacer 16*b* create a phase difference between pressure vibration and displacement. Adjusting such a phase difference to optimum generates a cryogenic temperature in the expansion space 17 which is adjacent to the cold head 12 and the resultant cryogenic temperature can be obtained from the cold head 12.

As apparent from the preceding explanations, the present invention restricts the pressure decrease in the high-pressure line and/or the pressure increase in the low-pressure line in the heat-regenerating type cryogenic cooling apparatus, increasing in its cryogenic efficiency. In addition, such restrictions in pressure decrease and/or increase pressure prevent or lessen the generation of ripples of the working gas in the high pressure line and/or the low-pressure line, thereby preventing lowering of the cryogenic efficiency.

The invention has thus been shown and description with reference to specific embodiments, however, it should be understood that the invention is in no way limited to the details of the illustrates structures but changes and modifications may be made without departing from the scope of the appended claims.

Obviously, numerous modifications and variations of the present invention are possible in light of the above teachings. It is therefore to be understood that within the scope of the appended claims, the invention may be practiced otherwise than as specifically described herein.

What is claimed is:

1. A heat-regenerating type cryogenic cooling apparatus comprising:

a cryogenic temperature generating part including a heat regenerator, a cold head and a pulse tube connected in series; and a pressure vibrating part connected to the cryogenic temperature generating part and establishing pressure vibration of a working gas therein, the pressure vibrating part including a compressor having a sucking port and a discharging port, a high-pressure line whose one end is connected to the discharge port of the compressor, a low pressure line whose one end is connected to the sucking port of the compressor, a high-pressure open/close valve connected to the other end of the high-pressure line, a low-pressure open/close valve connected to the other end of the low-pressure line, a high-pressure side passage connecting the high-pressure open/close valve and the cryogenic temperature generating part, a low-pressure side passage connecting the low-pressure open/close valve and the cryogenic temperature generating part, and a high-pressure source in fluid communication with the high-pressure line.

2. A heat-regenerating type cryogenic cooling apparatus as set forth in claim 1, wherein the high pressure source is a high-pressure side buffer tank.

3. A heat-regenerating type cryogenic cooling apparatus as set forth in claim 1, wherein the high pressure source has a volume which is 1–10 times larger than a volume of a working space which is defined in the cryogenic temperature generating part.

4. A heat-regenerating type cryogenic cooling apparatus comprising:

a cryogenic temperature generating part including a heat regenerator, a cold head and a pulse tube connected in series; and a pressure vibrating part connected to the cryogenic temperature generating part and establishing pressure vibration of a working gas therein, the pressure vibrating part including a compressor having a sucking port and a discharging port, a high-pressure line whose one end is connected to the discharge port of the compressor, a low pressure line whose one end is connected to the sucking port of the compressor, a high-pressure open/close valve connected to the other end of the high-pressure line, a low-pressure open/close valve connected to the other end of the low-pressure line, a high-pressure side passage connecting the high-pressure open/close valve and the cryogenic temperature generating part, a low-pressure side passage connecting the low-pressure open/close valve and the cryogenic temperature generating part, and a low-pressure source in fluid communication with the low-pressure line.

5. A heat-regenerating type cryogenic cooling apparatus as set forth in claim 4, wherein the low pressure source is a low-pressure side buffer tank.

6. A heat-regenerating type cryogenic cooling apparatus as set forth in claim 4, wherein the low pressure source has a volume which is 1–10 times larger than a volume of a working space which is defined in the cryogenic temperature generating part.

7. A heat-regenerating type cryogenic cooling apparatus comprising:

a cryogenic temperature generating part including a heat regenerator, a cold head and a pulse tube connected in series; and a pressure vibrating part connected to the cryogenic temperature generating part and establishing pressure vibration of a working gas therein, the pressure vibrating part including a compressor having a sucking port and a discharging port, a high-pressure line whose one end is connected to the discharge port of the compressor, a low pressure line whose one end is connected to the sucking port of the compressor, a high-pressure open/close valve connected to the other end of the high-pressure line, a low-pressure open/close valve connected to the other end of the low-pressure line, a high-pressure side passage connecting the high-pressure open/close valve and the cryogenic temperature generating part, a low-pressure side passage connecting the low-pressure open/close valve and the cryogenic temperature generating part, a high-pressure source in fluid communication with the high-pressure line, and a low-pressure source in fluid communication with the low-pressure line.

8. A heat-regenerating type cryogenic cooling apparatus as set forth in claim 7, wherein the high pressure source is a high-pressure side buffer tank.

9. A heat-regenerating type cryogenic cooling apparatus as set forth in claim 7, wherein the low pressure source is a low-pressure side buffer tank.

10. A heat-regenerating type cryogenic cooling apparatus as set forth in claim 7, wherein the high pressure source has a volume which is 1–10 times larger than a volume of a working space which is defined in the cryogenic temperature generating part, the low pressure source has a volume which is 1–10 times larger than the volume of the working space.

11. A heat-regenerating type cryogenic cooling apparatus comprising:

a cryogenic temperature generating part including a heat regenerator, a cold head and a pulse tube connected in series; and a pressure vibrating part connected to the cryogenic temperature generating part and establishing pressure vibration of a working gas therein, the pressure vibrating part including a compressor and at least one of a high pressure source and a low pressure source fluidically connected between said compressor and said cryogenic temperature generating part.

12. A heat-regenerating type cryogenic cooling apparatus as set forth in claim 11, wherein the high pressure source and the low pressure source each comprise is a buffer tank.

* * * * *